United States Patent [19]

Geiger

[11] Patent Number: 4,955,214

[45] Date of Patent: Sep. 11, 1990

[54] RAM PRESS FOR PRESSING LIQUID OUT OF MATERIAL BEING PRESSED

[75] Inventor: Friedrich Geiger, Heilbronn-Frankenbach, Fed. Rep. of Germany

[73] Assignee: Passat-Maschinenbau GmbH, Fed. Rep. of Germany

[21] Appl. No.: 350,698

[22] Filed: May 10, 1989

[30] Foreign Application Priority Data

May 13, 1988 [DE] Fed. Rep. of Germany ..... 3816372

[51] Int. Cl.[5] ..... D06F 47/06

[52] U.S. Cl. ..... 68/242; 100/110; 100/211; 100/229 R

[58] Field of Search ..... 68/241, 242, 21, 122; 100/110, 116, 211, 240, 245, 229 R

[56] References Cited

U.S. PATENT DOCUMENTS 1,226,183 5/1917 Budd ..... 68/122
1,738,326 12/1929 Smith ..... 68/242 X
3,992,405 11/1976 Oberley et al. ..... 68/241
4,575,949 3/1986 Bernecker ..... 68/242 X

FOREIGN PATENT DOCUMENTS 0060420 9/1982 European Pat. Off. ..... 68/242
2846760 5/1979 Fed. Rep. of Germany .
3506382 8/1986 Fed. Rep. of Germany .
8713472 2/1988 Fed. Rep. of Germany .
810486 12/1936 France ..... 68/122

*Primary Examiner*—Philip R. Coe
*Attorney, Agent, or Firm*—Wigman & Cohen

[57] ABSTRACT

During assembly of a ram press for pressing liquid out of material being pressed, centering of the shell 19 which serves as wash basket with the axis of the press ram which engages the shell 19 is simplified by the shell 19 being horizontally movable with two degrees of freedom by being connected for pivotal motion about a second vertical axis 26 to the free end of an arm 25 which is pivotable about a first vertical axies 24'.

16 Claims, 3 Drawing Sheets

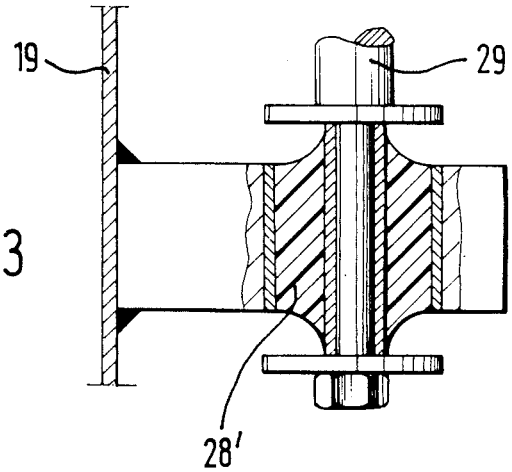
Fig.3
Fig.5
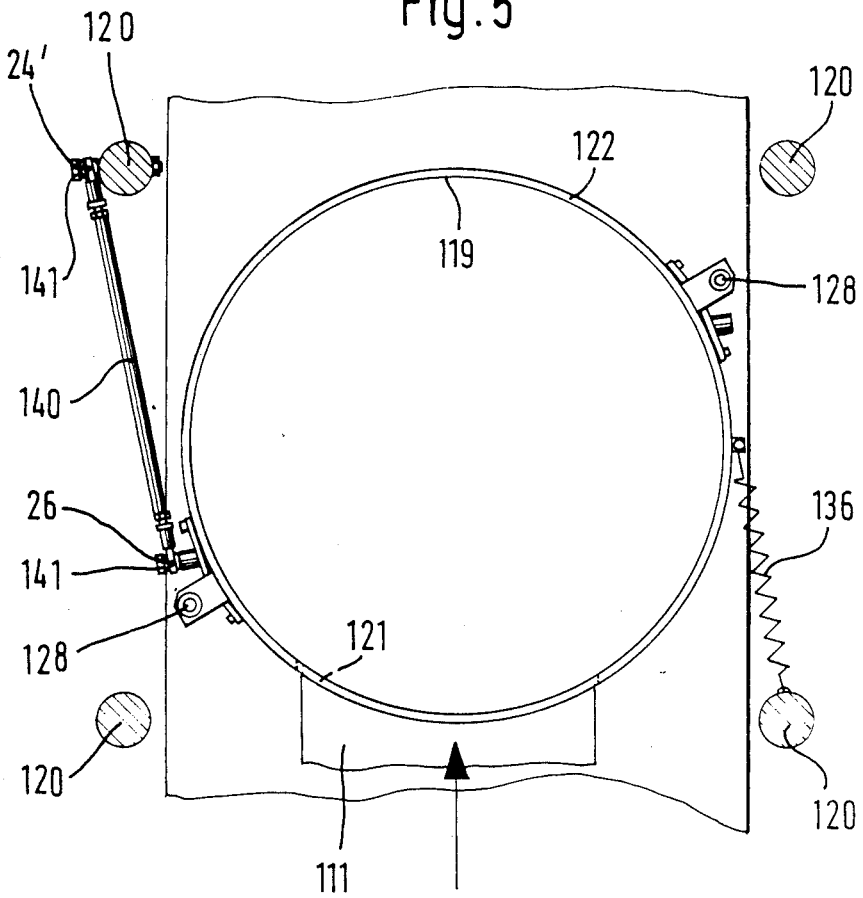

RAM PRESS FOR PRESSING LIQUID OUT OF MATERIAL BEING PRESSED

BACKGROUND OF THE INVENTION

1. FIELD OF THE INVENTION

The invention relates to a ram press for pressing liquid out of material being pressed. The material which is to be pressed is introduced into a cylindrical shell onto a perforated press plate arranged beneath the shell and pressed there by a press ram. To enable the press ram to enter the shell, it is guided in an upwardly and downwardly movable manner and drivable by a pressure cylinder carried by a press head which is fixedly connected to the press plate above the shell.

2. DESCRIPTION OF THE RELATED ART

A ram press of this kind is known from German Offenlegungsschrift (unexamined patent application) No. 2 846 760. In this known ram press, the shell is mounted for pivotal motion about a vertical axis so that after the material has been pressed out on the press plate, the shell can be moved into a position in which the pressed-out material can be conveyed away through the bottom opening in the shell.

A further ram press is known from German Offenlegungsschrift (unexamined patent application) No. 3 506 382. Herein, the shell is not mounted for pivotal motion but for motion up and down in the vertical direction.

For this up and down motion of the shell, the latter is attached to two arms which are guided along two vertical columns. After the material has been pressed out, the shell is raised to enable the pressed-out material to be conveyed away sidewardly.

In both known ram presses, introduction of the press ram into the shell requires that the press ram and the shell be arranged coaxially with each other with a very high degree of precision. This leads to considerable difficulties in the construction of the ram press owing to manufacturing tolerances. In a time-consuming operation, sheet metal spacers of various thicknesses must be inserted for centering the shell. Since the ram press is disassembled for transportation, problems arise again during assembly owing, for example, to the correct sheet metal spacers having to be inserted at the correct place. The same difficulties occur when the shell must be exchanged for different washing systems.

SUMMARY OF THE INVENTION

The object underlying the invention is to provide a ram press of the kind mentioned at the beginning which can be assembled without a high degree of expenditure.

This object is accomplished in accordance with the invention in a ram press of the kind mentioned at the beginning by the shell being horizontally movable with two degrees of freedom by connection for pivotal motion about a second vertical axis to the free end of an arm which is attached to a bearing carrier for pivotal motion about a first vertical axis.

By virtue of this pivotable connection of the shell to an arm which is pivotable about a pivot axis, the shell can be horizontally moved to any point within the region in question without any structural changes having to be carried out.

Consequently, the component parts of the ram press can be manufactured with larger tolerances and there is no necessity for centering by means of sheet metal spacers or the like during assembly.

In order to achieve the same function as in a ram press of the kind known from German Offenlegungsschrift (unexamined patent application) No. 2 846 760 wherein the shell must be pivoted away for delivery of the pressedout material, in the ram press according to the invention a locking device may be provided for the second pivot axis. In this way, the effective lever arm of the shell can be fixed with respect to the first pivot axis and so a stop is sufficient to pivot the shell back into the position in which it is coaxial with the press ram after it has been pivoted away from the press plate for delivery of the pressed-out material.

In order to attain the function of a ram press wherein the shell is raised for removal of the pressed-out material, as, for example, in the ram press according to German Offenlegungsschrift (unexamined patent application) No. 3 506 382, provision may be made in an advantageous embodiment of the invention for the shell and the press head to be connected for pivotal motion all round to the two ends of at least one lifting cylinder. In this way, the movability of the shell in the horizontal plane is not impeded by the lifting cylinder.

In a further advantageous embodiment, provision may be made for the stroke of the lifting cylinder to be so limited that when the press ram is raised, the shell can only be lowered, for introduction of the material to be pressed, to a position in which there remains between the bottom rim of the shell and the press plate a narrow gap into which the material to be pressed cannot penetrate. In this way, the lowering of the shell is practically soundless as the shell does not touch the press plate in its lowest position.

This embodiment, therefore, avoids the hard impact which occurs in known ram presses of this kind and the resulting noise. If a conveyor belt is arranged in a known manner on the press plate to convey the pressed-out material away when the shell is raised, the conveyor belt is then preserved by this limitation of the stroke of the lifting cylinder and the resulting avoidance of the impact of the shell.

If, as described, for example, in German Offenlegungsschrift (unexamined patent application) No. 3 506 382, the press ram comprises a pot-shaped, elastically resilient cushioning member on its underside, this cushioning member expands radially outwardly once the material is pressed. The shell is thereby pressed downwardly in a frictionally connected manner by the press ram during its motion in the downward direction. In order to make use of this pressure, provision is made in an advantageous embodiment for the stroke of the lifting cylinder to be elastically resiliently limited. The shell is thereby moved slowly towards the press plate during the pressing operation and the gap is closed practically without a sound.

The shell may comprise a lateral feed opening in its top rim for introduction of the material which is to be pressed out. If provision is made for the stroke of the press ram to be so adapted to the height of the shell that in the maximum lowered position of the shell, the press ram in its maximum raised position still engages the shell, in this embodiment the cushioning member provided on the press ram can thereby be easily prevented from striking the bottom edge of the lateral feed opening. This is achieved by the shell being engaged by at least one pull means which presses it at least in its lowest position with its inner side that is located opposite the feed opening towards the press ram.

In the inventive modification of the type of ram press according to German Offenlegungsschrift (unexamined patent application) No. 2 846 760, a vertical pivot column forming the pivot axis and a vertical guide may be provided as bearing carrier for the arm carrying the shell. In a particularly advantageous embodiment, the arm is designed as a parallelogram of rods comprising two rods arranged in spaced relation one on top of the other, to the free ends of which the shell is attached for pivotal motion about the second axis.

If provision is made herein for both ends of the rods of the parallelogram of rods to be connected to the bearing carrier and the shell for pivotal motion all round and for at least two synchronously operating lifting cylinders to engage the shell at two points located on both sides of a vertical diametral plane of the shell which is parallel to the vertical plane in which the rods of the parallelogram of rods are arranged, displaceable mounting of the arm on the vertical pivot column is then no longer required for the ram press of this kind. This results in a further simplification of assembly of the ram press.

The invention is explained in detail in the following description of two embodiments illustrated in the drawings.

BRIEF DESCRIPTION OF THE DRAWINGS

FIG. 3 is an axial section of an elastomeric joint for a modification of the first embodiment;

FIG. 5 is a plan view of the shell according to FIG. 4.

DESCRIPTION OF THE PREFERRED EMBODIMENTS

Figure 1:
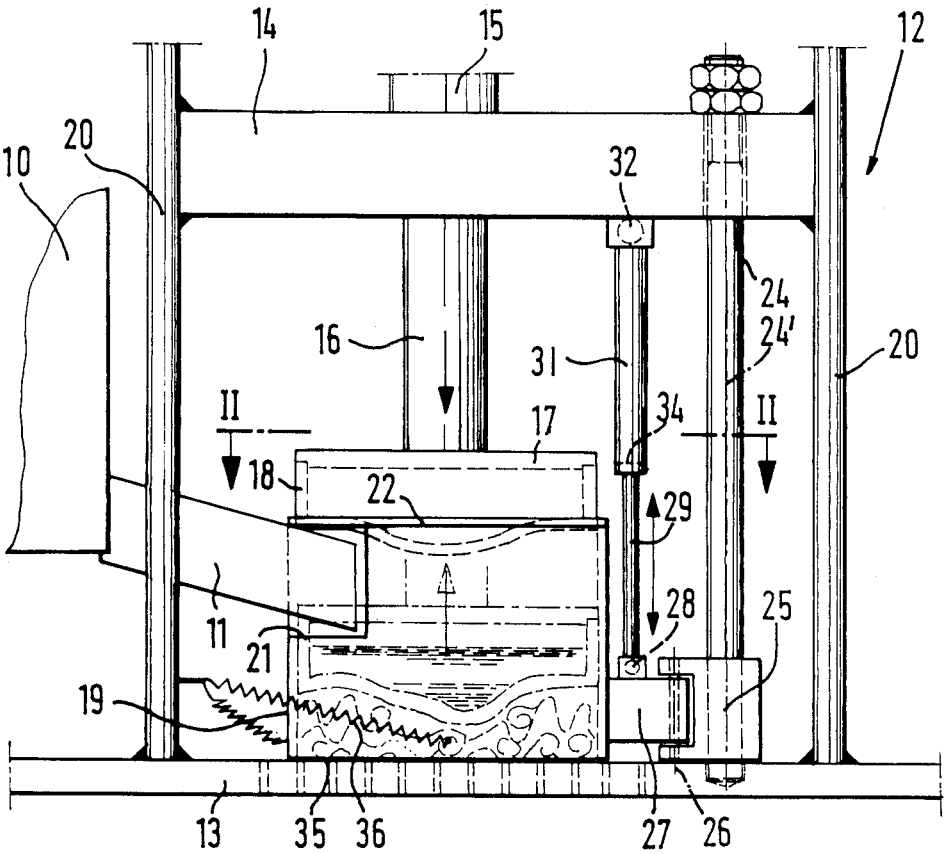
FIG. 1 is a side view of the first embodiment of a ram press according to the invention.
Figure 2:
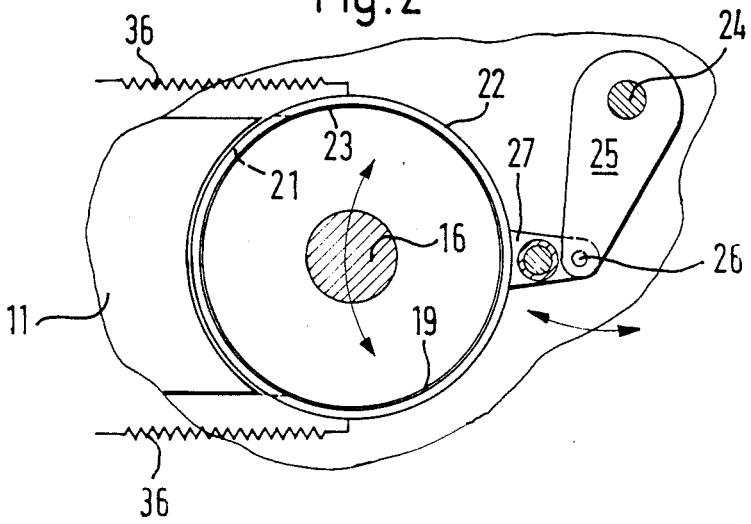
FIG. 2 is a partially illustrated section along line II—II in FIG. 1.

The embodiment of a ram press illustrated in FIGS. 1 and 2 is preceded by an automatically operating washing machine 10 indicated in a broken-off manner only in FIG. 1. For delivery of the washed, still wet textile materials, the washing machine 10 comprises a guide channel 11 which feeds the wet textile materials in batches to the ram press.

The ram press comprises a frame 12 wherein a press head 14 is arranged above a perforated press plate 13. The press head 14 is fixedly connected to the press plate 13 by four columns 20. Fixedly arranged on the press head 14 is a pressure cylinder 15, the piston rod 16 of which protrudes at the bottom from the press head and carries a press ram 17. On its underside, the press ram 17 is connected to the edge of an opening in a pot-shaped cushioning member 18 made of an elastically resilient material, for example, rubber, plastic or the like. For the operating state, the cushioning member is filled with a fluid pressure medium, for example, with water, as described, for example, in German Utility Model 8 713 472.

A circular-cylindrical shell 19 which is open at both ends and serves as wash basket is arranged beneath the press ram 17. In its upper rim, the shell 19 comprises a lateral feed opening 21 into which the guide channel 11 of the washing machine 10 opens. The feed opening 21 is closed at the top by a ring 22 surrounding the shell 19 at its top opening. The clear internal diameter of the shell 19 corresponds essentially to the external diameter of the press ram 17 and its cushioning member 18. To introduce the press ram 17 into the shell 19, the top opening of the latter is of slightly conically widened configuration, as indicated by the conical surface 23 in FIG. 2.

A vertical column 24 which is fixedly connected to the press plate 13 and the press head 14 serves as bearing carrier and as guide and pivot axis 24' for an arm 25 which is connected at its free end to a second arm 27 for pivotal motion about a second axis 26. The second arm 27 is rigidly attached to the shell 19. The piston rod 29 of a lifting cylinder 31 engages the second arm 27 by means of a ball-and-socket joint 28. By means of a further ball-and-socket joint 32, the lifting cylinder 31 is connected to the press head 14. The upward motion of the piston rod 16 is limited so that when the shell 19 is lowered onto the press plate 13, the cushioning member 18 still engages the upper rim of the shell 19. The arm 25 may be pivotably and axially displaceably mounted on one of columns 20 instead of on a separate guide column 24.

In the position of the press ram 17 and the shell 19 shown in FIG. 1, the lifting cylinder 31 is illustrated in its extended position in which its stroke is limited by an elastically resilient, i.e., elastomeric stop 34. This extended position of the lifting cylinder 31 is so dimensioned that the shell 19 is located at a short distance above the press plate 13, thus leaving between the bottom rim of the shell and the press plate 13 a narrow gap 35 into which the washed material cannot penetrate. In a modification illustrated in FIG. 3, the ball-and-socket joint 28 is replaced by an elastomeric joint 28' which connects the shell 19 with the piston rod 29 in the fashion of a ball-and-socket joint and by virtue of its axial resilience serves as a substitute for the elastomeric stop 34.

In the position illustrated in FIG. 1, only the resilient cushioning member 18 of the press ram 17 engages the shell 19 from above. Therefore, to exclude the possibility of the shell 19 being horizontally shifted to the right in FIGS. 1 and 2 by the force of the batches of wet textile materials being thrown into the shell 19, two springs 36 engage as pull means on two diametrically opposed points on the shell 19. The springs 36 pull the shell with the inner side thereof that is located opposite the feed opening 21 towards the press ram 17.

This ensures that the press ram 17 does not strike the bottom edge of the feed opening 21 as it enters the shell 19. The same effect can be achieved with one spring 36 alone or by a spatially fixed stop for the shell 19 in its lowest position which, for example, in FIG. 1, could be arranged immediately below arm 27 on the press plate 13.

When the embodiment of the ram press shown in FIGS. 1 and 2 is being assembled, the position of the shell 19 with respect to the press ram 17 does not require adjustment. It is sufficient for the guide column 24 to be aligned vertically and parallel to the piston rod 16. By virtue of its pivotable mounting about the two axes 24' and 26, the shell 19 can then be moved very easily into the position in which the press ram 17 engages the upper rim of the shell 19. This motion of the shell 19 is not impeded by the lifting cylinder 31 as the latter is connected with the press head 14 and the arm 27 for pivotal motion all round by the ball-and-socket joints 28 and 32.

During the coordinated operation of the washing machine 10 and the ram press illustrated in FIGS. 1 and 2, in the position of the shell 19 and the press ram 17 shown in FIG. 1, a batch of wet washed material is introduced into the shell 19 through the channel 11. The pressure cylinder 15 is then actuated so that the press ram 17 is introduced with the filled cushioning member 18 into the shell 19 and pressed onto the batch of wet washed material, as illustrated in dot-and-dash lines in FIG. 1. Once the water has been pressed out of the batch of wet washed material in this way, the lifting cylinder 31 and subsequently the pressure cylinder 15 are actuated again to raise the shell 19 and the press ram 17 so that the pressed-out batch of washed material then only rests on the press plate 13 and can be conveyed away sidewardly. A conveyor belt, not illustrated in the drawings, may be arranged above the press plate and beneath the shell 19 for this purpose.

Once the washed material has been conveyed away, the lifting cylinder 31 is actuated to move the shell 19 back into the position shown in FIG. 1. During this motion, the shell 19 does not strike the press plate 13 but remains at the distance above the press plate 13 that is determined by the gap 35. During the next pressing operation, once the press ram 17 starts to press the batch of wet washed material, the cushioning member 18 expands radially outwardly, thereby causing friction between the cushioning member 18 and the inside wall of the shell 19, by means of which the shell 19 is slowly pressed onto the press plate 13 against the elastic force of the elastomeric stroke limitation. This occurs without any striking noise.

Figure 4:
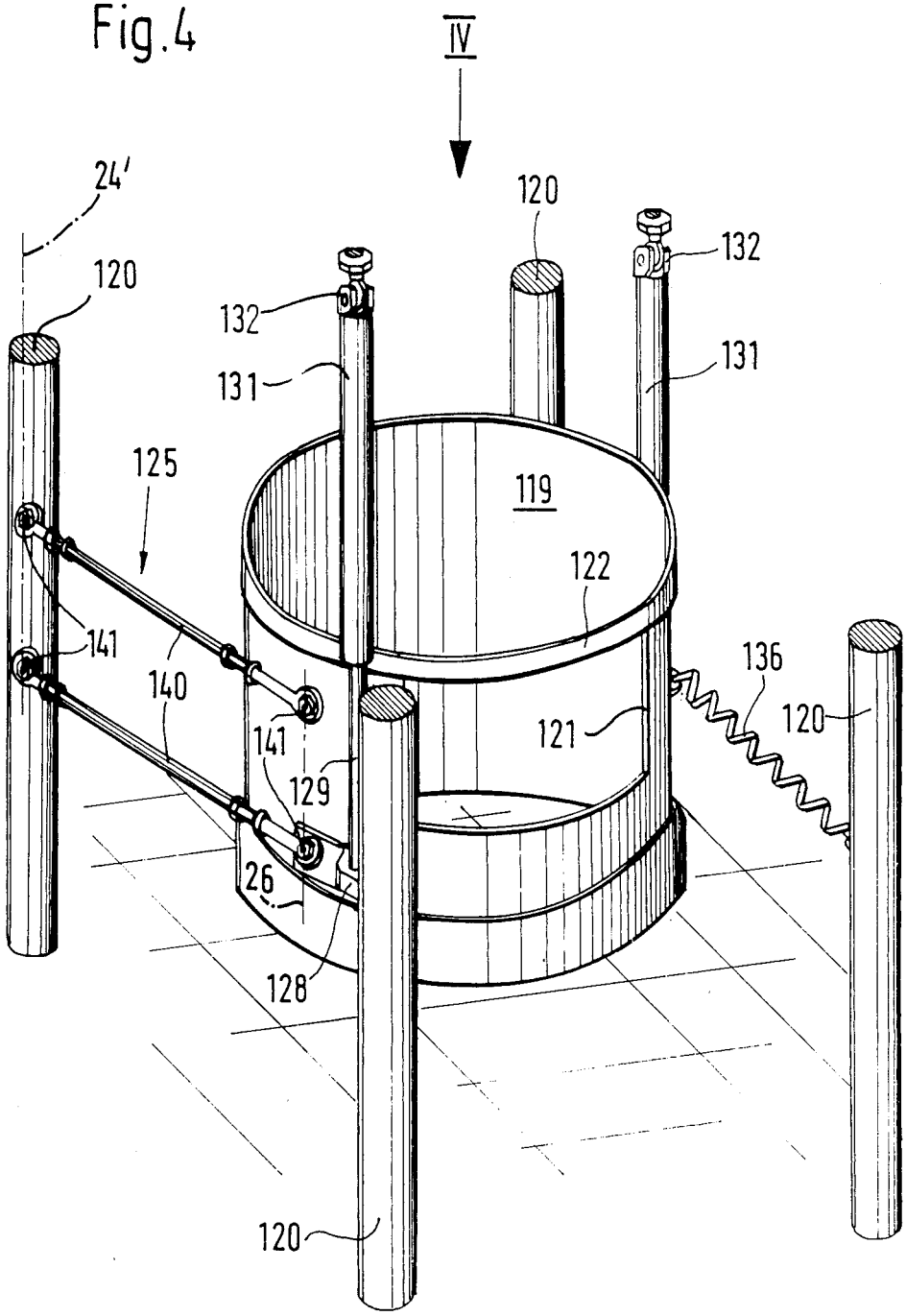
FIG. 4 is a perspective view of the mounting of the shell of a second embodiment.

Of the embodiment shown in FIGS. 4 and 5, only the mounting of the shell is shown in schematically simplified form. In order to avoid repetitions, reference numerals greater by 100 than the reference numerals of the first embodiment are used for parts of the embodiment of FIGS. 4 and 5 which coincide in their function with the parts of the embodiment of FIGS. 1 and 2. Reference is made by way of this indication to the description of the first embodiment.

The embodiment shown in FIGS. 4 and 5 differs from the first embodiment in that the carrier arm of the shell 119 is designed as a parallelogram of rods, designated in its entirety 125, which comprises two parallel rods 140 arranged in spaced relation one above the other in a vertical plane. The one ends of these rods 140 are attached to one of the four columns 120 for pivotal motion all round by means of ball-and-socket joints 141.

The other ends of the rods 140 are connected to the shell 119 likewise by ball-and-socket joints 141. To prevent the rods 140 from pivoting out of the vertical plane of the parallelogram of rods which is defined by the rod axes, two synchronized lifting cylinders 131 engage the shell 119. As in the first embodiment, the lifting cylinders 131 are connected to the press head 14 according to FIG. 1, not illustrated in FIGS. 4 and 5, by means of ball-and-socket joints 132. The two lifting cylinders 131 engage with their piston rods 129 via the ball-and-socket joints 128 points on the shell 119 arranged on both sides of that vertical diametral plane of the shell 119 which is parallel to the vertical plane defined by the axes of the rods 140 when the shell 119 is arranged coaxially with the press ram 17 in accordance with FIG. 1. Similarly to the ball-and-socket joints 28' of FIG. 3, the ball-and-socket joints 128 may be designed as elastomeric joints in order to limit the stroke of the lifting cylinders 131 in an elastically resilient manner.

In the illustrated embodiment, the axes of the two lifting cylinders 131 lie in a vertical diametral plane of the shell 119 which extends substantially perpendicularly to the vertical plane of the parallelogram of rods 125 which is defined by the axes of the rods 140. This prevents tilting of the shell 119 and so the latter is connected to the one column 120 and to the press head 14 illustrated in FIG. 1 for raising and lowering and for displacement in a horizontal plane with an always vertically extending shell axis. A tension spring 136 joins a point on the shell 119 located opposite the parallelogram of rods 125 with a column 120 which is located approximately diametrically opposite to the column 120 carrying the parallelogram of rods 125 in relation to the shell 119.

The feed opening 121 is arranged between the point of contact of the parallelogram of rods 125 on the shell 119 and the point of contact of the spring 136, on the side of the shell 119 facing the viewer in FIG. 4. The ring 122 surrounding the shell 119 closes the feed opening 121 at the top. FIG. 5 shows schematically the guide channel 111 which delivers the batch of wet washed material to the feed opening 121 of the shell 119.

The special mounting of the shell 119 by means of the parallelogram of rods 125 and the two lifting cylinders 131 enables completely problem-free assembly of the ram press at the operating premises for once the dimensions have been laid down during manufacture, no further adjustments are necessary during assembly of the ram press.

Otherwise, the mode of operation of the embodiment of FIGS. 4 and 5 is the same as in the embodiment of FIGS. 1 and 2. Reference is, therefore, made to the description thereof.

In a third embodiment, not illustrated, at each end of the parallelogram of rods 125, the two rods 140 are connected to a common sleeve for pivotal motion about horizontal axes. The common sleeve is pivotable about a vertical axis. By means of this mounting alone, the rods 140 are prevented from moving out of their vertical plane and, therefore, tilting of the shell 119 is not possible. With this mounting of the rods 140 of the parallelogram of rods 125, as in the first embodiment, only one single lifting cylinder 131 is necessary and it engages the shell 119, for example, in the proximity of the parallelogram of rods 125.

In a fourth embodiment, not illustrated in the drawings, wherein the shell 19 is not raised from the press plate 13 but only pivoted away, in order to convey away the pressed-out material, a locking device is provided for the second pivot axis 26 connecting the arm 25 to the second arm 27. During assembly of the ram press, after introduction of the press ram 17 into the shell 19, this locking device serves to lock the second pivot axis 26 so that the thus fixed radial spacing of the axis of the shell 19 from the axis of the pivot column 24 remains constant during operation of the ram press. With the second axis 26 thus locked, in order to re-position the shell 19 coaxially with the press ram 17 after it has been pivoted away, the shell 19 has only to be provided with a stop which defines the position of the shell 19 coaxially with the press ram 17. In this embodiment, the pivoting of the shell 19 out of its position in which it is coaxial with the press ram 17 along the surface of the press plate pushes the pressed-out material off the press plate so that it can fall out of the bottom opening in the shell 19 into a collecting vessel or the like. When the shell 19 pivots back to the aforementioned stop, the locking of the second pivot axis 26 causes the shell to return to precisely the position in which it is coaxial with the press ram and so the press ram which, in this embodiment, is fully raised out of the shell 19 can be introduced into the shell again without any difficulty.

In the last mentioned embodiment, provision may also be made for the shell to be movable up and down as in the first embodiment. The pressed material can then be conveyed away in two different ways. For example, the pressed material can be conveyed away by a conveyor belt arranged beneath the shell when the shell 19 has been raised and other pressed material can be conducted away by the shell being sidewardly pivoted away as described in conjunction with the fourth embodiment.

In a further modification of the two above-described embodiments which is not illustrated in the drawings, at least one other pull means in the form of a rope, a chain or a bar having an elongate hole at one end thereof may be provided instead of the springs 36 and 136, respectively.

Like the rods 140 of the parallelogram of rods 125, the rope or the chain may be attached at a point on a column 20 and 120, respectively, and at a place on the shell 19 and 119, respectively, which is lower than this point. The length of the rope or the chain is then so selected that this pull means is tensioned in the lowest position of the shell 19 and 119, respectively, and thereby pulls the shell 19 and 119, respectively, towards the press ram 17 to thereby prevent the press ram from striking the bottom edge of the feed opening 21 and 121, respectively, on entering the shell, as explained in conjunction with the springs 36 in the description of the first embodiment.

Instead of a rope or a chain, a bar, not illustrated, which connects a column 20 or 120 to the shell 19 or 119 may be used. The connection at one end of the bar is established by a bolt engaging an elongate hole. Depending on the arrangement of the bar, the horizontal component of its longitudinal axis is shortened or lengthened when the shell 19 or 119 is lowered into its lowest position. Therefore, by virtue of appropriate arrangement, the bar can act as pull or pressure means when the shell is lowered into its lowest position, in order to achieve the same effect as the springs 36 and 136, respectively.

By virtue of the elongate hole-bolt connection, the bar acts only as pull or pressure means and does not exert any force on the shell when it is raised. In the embodiment according to FIGS. 4 and 5, it must also be taken into consideration that due to the shortening of the length of the horizontal component of the rods 140, these exert a pulling force on the shell 119 as it is lowered.

The foregoing description and the drawings relate to the features which are essential to the materialization, by way of example, of the invention. Therefore, insofar as features are disclosed in the description and drawings but are not mentioned in the claims, these serve, if necessary, to also define the subject of the invention.

I claim:

1. Ram press for pressing liquid out of material being pressed, comprising a container means having a vertical, cylindrical cavity with a top and a bottom opening for said material which is to be pressed, a perforated means for closing off said bottom opening, a pressing means for introduction into said top opening of said container means and for compressing said material which is to be pressed when the latter is located on said perforated means in said cylindrical cavity, a driving means for moving said pressing means up and down, and a carrying means for carrying said driving means and being fixedly connected to said perforated means, characterized in that a lever means is mounted for pivotal motion about a first vertical axis, and in that said container means is connected to said lever means for pivotal motion about a second vertical axis so that said container means is horizontally movable with two degrees of freedom.

2. Ram press as defined in claim 1, characterized in that a column (20, 24, 120) which connects said perforated means with said carrying means is provided as said first axis.

3. Ram press as defined in claim 2, characterized in that said column forms a vertical guide for said lever means.

4. Ram press as defined in claim 1, characterized in that said container means is movable up and down, and in that a lifting means with two ends which are movable relative to each other is provided, the one end thereof being connected to said container means and the other end thereof to said carrying means.

5. Ram press as defined in claim 4, characterized in that the stroke of said lifting means is so limited that when said pressing means is raised, said container means can only be moved down to a position in which there remains between said bottom opening of said container means and said perforated means a gap which is so narrow that said material which is to be pressed cannot penetrate into said gap.

6. Ram press as defined in claim 5, characterized in that the stroke of said lifting means is elastically resiliently limited.

7. Ram press as defined in claim 4, characterized in that the stroke of said pressing means is so adapted to the height of said container means that when said container means is in its maximum lowered position, said pressing means in its maximum raised position still engages said container means.

8. Ram press as defined in claim 7, characterized in that at least one pull or pressure means engages said container means at the side and presses said container means at least in its lowest position with its inner side that is located opposite said feed opening towards said pressing means.

9. Ram press as defined in claim 8, characterized in that a spring (36, 136) is provided as pull or pressure means.

10. Ram press as defined in claim 1, characterized in that said container means has a lateral feed opening beside said top opening.

11. Ram press as defined in claim 10, characterized in that said feed opening is closed at the top.

12. Ram press as defined in claim 1, characterized in that said lever means is designed as a parallelogram of rods comprising two parallel rods arranged in spaced relation one above the other in a vertical plane, each of which has two ends, and in that the one of said ends are connected for pivotal motion about said first axis, and in that the other of said ends are connected to said container means for pivotal motion about said second axis.

13. Ram press as defined in claim 12, characterized in that said one ends of said rods of said parallelogram of rods are connected to a fixed bearing carrier for pivotal motion all round and said other ends are connected to said container means for pivotal motion all round, and in that at least two synchronously operating lifting means engage said container means at two points located on both sides of a vertical diametral plane of said container means which is parallel to said vertical plane in which said rods of said parallelogram of rods are arranged.

14. A ram press for pressing liquid out of a material comprising:

a container for the material having an open top;

a perforated base means associated with said container;

pressing means having a central vertical axis;

first mounting means for mounting said pressing means above said open top of said container for a movement along a path parallel to said vertical axis;

second mounting means for mounting said container for a movement with two degrees of freedom substantially perpendicularly to said vertical axis of said pressing means between a position in which said open top of said container is not aligned with said pressing means and an aligned position in which said open top of said container is aligned with said pressing means so that said pressing means can be introduced through said open top into said container; and first driving means for driving said pressing means between a position in which said pressing means is out of said container and a position in which said pressing means penetrates said container when said open top of said container is aligned with said compressing means to compress material in said container between said pressing means and said perforated base means.

15. The ram press as defined in claim 14, wherein said container further comprises:

a side wall which laterally surrounds a cavity and forms a top and a bottom opening of said cavity; and lifting means for lifting said side wall from a lower position, in which said bottom opening is adjacent to said perforated base means for compressing the material contained in said cavity, to a lifted position, in which said bottom opening is spaced from said perforated base means for removing the pressed-out material from said perforated base means.

16. The ram press according to claim 15, further comprising:

an arm for supporting said side wall, said arm having a first and a second end;

first bearing means for pivotally supporting said first end of said arm about a first vertical axis; and second bearing means for pivotally supporting said side wall pivotally about a second vertical axis at said second end of said arm, so that said side wall can be moved with two degrees of freedom laterally to said vertical axis of said pressing means.

* * * * *